US008816521B2

(12) United States Patent
Kleen et al.

(10) Patent No.: US 8,816,521 B2
(45) Date of Patent: Aug. 26, 2014

(54) SYSTEM FOR STABILIZING POWER OUTPUT BY LOW-INERTIA TURBINE GENERATOR

(75) Inventors: Randall John Kleen, Channelview, TX (US); Hardik Ashok Purani, Edmonton (CA)

(73) Assignee: General Electric Company, Schenectady, NY (US)

( * ) Notice: Subject to any disclaimer, the term of this patent is extended or adjusted under 35 U.S.C. 154(b) by 258 days.

(21) Appl. No.: 13/421,700

(22) Filed: Mar. 15, 2012

(65) Prior Publication Data

US 2013/0241203 A1 Sep. 19, 2013

(51) Int. Cl.
*F01D 15/10* (2006.01)

(52) U.S. Cl.
USPC ..... 290/52

(58) Field of Classification Search
USPC ..... 290/52, 40 R, 39, 11
See application file for complete search history.

(56) References Cited

U.S. PATENT DOCUMENTS

| | | | | |
|---|---|---|---|---|
| 5,214,333 | A | 5/1993 | Kawamura | |
| 5,233,888 | A * | 8/1993 | Fukuda | 477/30 |
| 5,259,269 | A | 11/1993 | Swenson, Sr. | |
| 5,341,060 | A | 8/1994 | Kawamura | |
| 6,819,012 | B1 | 11/2004 | Gabrys | |
| 2003/0218385 | A1 * | 11/2003 | Bronicki | 307/43 |
| 2008/0121448 | A1 * | 5/2008 | Betz et al. | 180/65.3 |
| 2011/0295453 | A1 * | 12/2011 | Betz et al. | 701/22 |

OTHER PUBLICATIONS

U.S. Appl. No. 13/329,203, filed Dec. 16, 2011, Ronald Fredrick Tyree.

* cited by examiner

*Primary Examiner* — Jean F Duverne
(74) *Attorney, Agent, or Firm* — Fletcher Yoder P.C.

(57) ABSTRACT

A system includes a gas turbine engine and a flywheel coupled to the gas turbine engine. The gas turbine engine includes at least one compressor stage, at least one combustor, and at least one turbine stage. The flywheel is configured to store a rotational energy from the gas turbine engine, and the rotational energy stored by the flywheel is configured to resist changes in a rotational speed.

20 Claims, 7 Drawing Sheets

SYSTEM FOR STABILIZING POWER OUTPUT BY LOW-INERTIA TURBINE GENERATOR

BACKGROUND OF THE INVENTION

The subject matter disclosed herein relates to gas turbine generators, and more particularly, to systems and methods for stabilizing power output by a low-inertia generator.

Gas turbine engines may include, in serial flow arrangement, a compressor for compressing air flowing through the engine, a combustor in which fuel is mixed with the compressed air and ignited to form a hot gas flow, and a turbine driven by the hot gas flow. Such gas turbine engines may also include a low-pressure turbine or power turbine for transmitting power generated by the compressor, combustor, and turbine to a driven component, such as a generator, for example. A gas turbine engine combined with an electrical generator may collectively make up a power generation unit, e.g., a gas turbine generator. Such power generation units generally provide alternating current to a power grid at a nominal frequency (e.g., 50 Hz or 60 Hz). At times, however, the power grid frequency may become disturbed and may vary from the nominal frequency. Such frequency disturbances may occur, for example, when power generation units are unexpectedly added or removed from a power grid, or when a load connected to the power grid is unexpectedly added or dropped. Unfortunately, a large load change on a utility grid or within an industrial facility can cause rapid destabilization of connected generators, particularly low inertia generators.

BRIEF DESCRIPTION OF THE INVENTION

Certain embodiments commensurate in scope with the originally claimed invention are summarized below. These embodiments are not intended to limit the scope of the claimed invention, but rather these embodiments are intended only to provide a brief summary of possible forms of the invention. Indeed, the invention may encompass a variety of forms that may be similar to or different from the embodiments set forth below.

In a first embodiment, a system includes a gas turbine engine, an electrical generator coupled to the gas turbine engine, and a flywheel coupled to the gas turbine engine. The electrical generator is configured to output a power to a power grid. The flywheel is configured to store a rotational energy from the gas turbine engine, and the rotational energy stored by the flywheel is configured to resist changes in a rotational speed of the electrical generator to stabilize a frequency of the power during a grid destabilizing event on the power grid.

In a second embodiment, a system includes a turbine generator flywheel configured to couple to a turbine generator having a gas turbine engine coupled to an electrical generator. The system also includes a controller. The turbine generator flywheel is configured to store a rotational energy from the gas turbine engine, and the rotational energy stored by the turbine generator flywheel is configured to resist changes in a rotational speed of the electrical generator to stabilize a frequency of the power during a grid destabilizing event on the power grid. The turbine generator flywheel includes an adjustable inertia mechanism having at least one weight coupled to a radial adjuster configured to move the at least one weight in a radial direction relative to a rotational axis. The controller is coupled to the radial adjuster to move the at least one weight to adjust an inertia of the turbine generator flywheel to help stabilize the frequency of the power.

In a third embodiment, a system includes a gas turbine engine and a flywheel coupled to the gas turbine engine. The gas turbine engine includes at least one compressor stage, at least one combustor, and at least one turbine stage. The flywheel is configured to store a rotational energy from the gas turbine engine, and the rotational energy stored by the flywheel is configured to resist changes in a rotational speed.

BRIEF DESCRIPTION OF THE DRAWINGS

These and other features, aspects, and advantages of the present invention will become better understood when the following detailed description is read with reference to the accompanying drawings in which like characters represent like parts throughout the drawings, wherein.

DETAILED DESCRIPTION OF THE INVENTION

One or more specific embodiments of the present invention will be described below. In an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present invention, the articles "a," "an," "the," and "said" are intended to mean that there are one or more of the elements. The terms "comprising," "including," and "having" are intended to be inclusive and mean that there may be additional elements other than the listed elements.

The disclosed embodiments are directed to systems and methods for stabilizing the frequency of power output to a power grid by a low-inertia electrical generator powered by a gas turbine engine. In certain embodiments, the gas turbine engine may be a low-inertia gas turbine engine, such as an aero-derivative gas turbine engine. Examples of such aero-derivative gas turbine engines include the LMS100, LM2500, LM6000, LM1800e, LM1600, and TM2500 series of aero-derivative gas turbines manufactured by General Electric Company of Schenectady, N.Y. Thus, the generator and the gas turbine both may have a low inertia, which is susceptible to sudden changes in load or other destabilizing events. As discussed below, the disclosed embodiments involve coupling a flywheel to the electrical generator, wherein the flywheel is used to store rotational energy from the gas turbine engine that may be used to resist changes in rotational speed of the electrical generator. This may be useful for stabilizing the power output from the electrical generator to the power grid during grid destabilizing events (i.e., a sudden fault or a change in the load on the power grid). The flywheel may be coupled to the generator, either at a position between the gas turbine engine and the electrical generator, or on a side of the electrical generator opposite the gas turbine engine. Placing the flywheel in this second position may allow the flywheel to stabilize power output from the electrical generator when the generator is decoupled from the gas turbine engine, such as when operating in a synchronous condensing mode.

Figure 1:
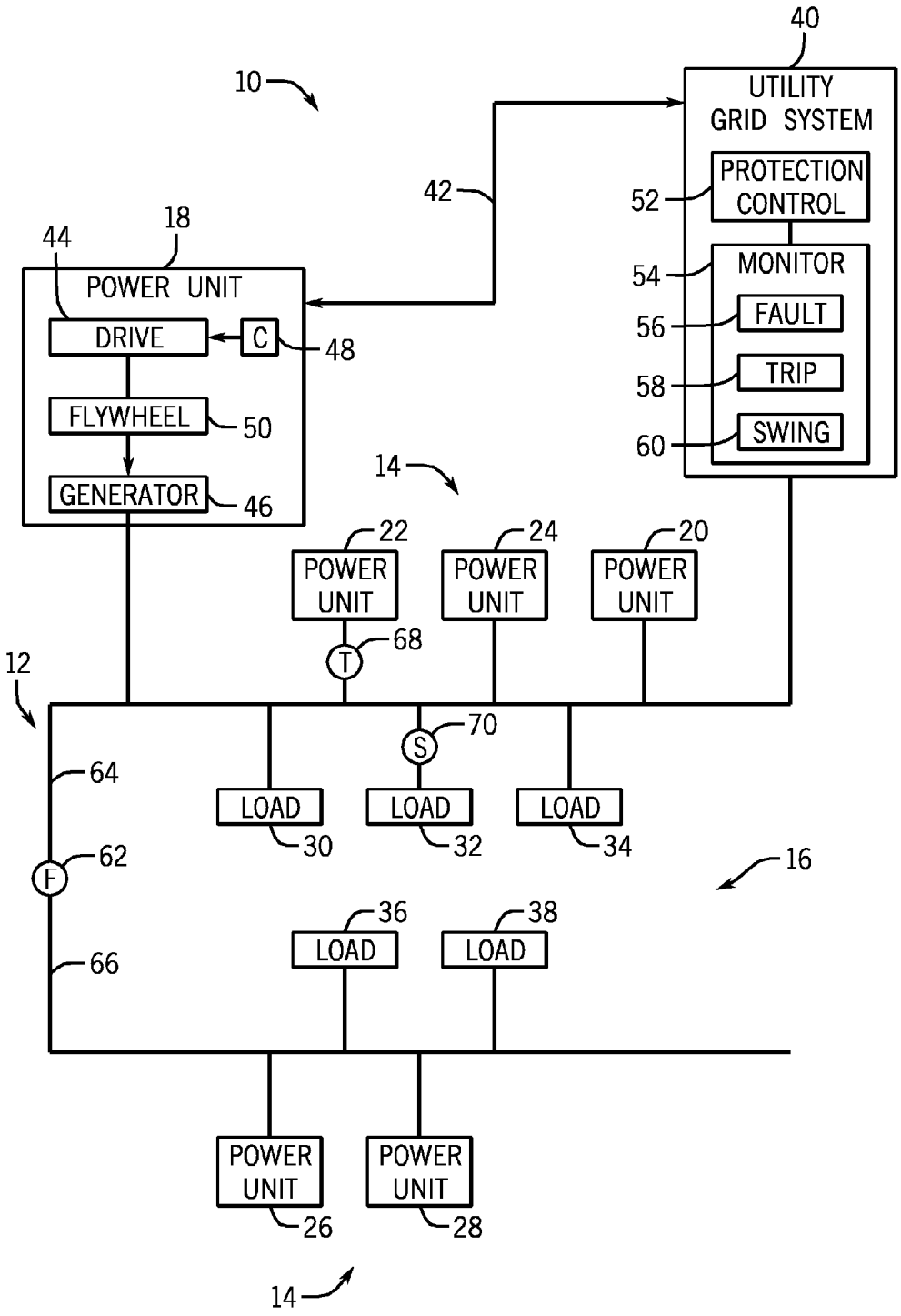
FIG. 1 is a block diagram of an embodiment of an electrical system in which a power generation unit may include a flywheel for stabilizing a frequency of power output by the power generation unit.

With the foregoing in mind, FIG. 1 is a block diagram of an embodiment of an electrical system 10, which includes a power grid 12 supplied by power units 14. As illustrated, the electrical system 10 includes the power grid 12 coupled to distributed power units 14 and distributed loads 16. The distributed power units 14 may include a plurality of power units 18, 20, 22, 24, 26, and 28. Each of these distributed power units 14 is configured to generate power for distribution on the power grid 12. The distributed loads 16 may include a plurality of loads 30, 32, 34, 36, and 38. Each of these distributed loads 16 is configured to draw power from the power grid 12 to operate machinery, buildings, and other systems. The illustrated electrical system 10 also includes a utility grid system 40 coupled to the power grid 12. The utility grid system 40 may provide certain control over the power grid 12 and may detect various grid destabilizing events, such as transient stability upsets, in the power grid 12. These transient stability upsets may correspond to severe changes in frequency or loading on the power grid 12. Additionally, when such events occur, the utility grid system 40 may receive a utility signal 42 from one or more of the power units 14. The utility signal 42 may indicate whether the power unit 14 is responding to the disturbance in a manner that complies with a specification associated with the power grid 12 (e.g., a local rule or regulation). In certain embodiments, the utility signal 42 may indicate in real-time whether the response of the power unit 14 complies with the specification.

The distributed power units 14 may include a variety of power generation systems configured to distribute power onto the power grid 12. For example, such a distributed power unit 14 may include generators driven by a reciprocating combustion engine, a gas turbine engine, a steam turbine engine, a hydro-turbine, a wind turbine, and so forth. The distributed power unit 14 also may include large arrays of solar panels, fuel cells, batteries, or a combination thereof. The size of these distributed power units 14 also may vary from one unit to another. For example, one power unit 14 may have a substantially larger inertia than another power unit 14 on the power grid 12. For example, a gas turbine engine may have a substantially lower inertia than a hydroturbine or a steam turbine.

In the illustrated embodiment, the power unit 18 represents a relatively low inertia power unit 14, which includes a drive 44 coupled to a generator 46. The power unit 18 also includes a controller 48, which may provide a proportional-acting or other control of the drive 44, and the drive 44 is configured to rotate the generator 46 for power generation in response to signals from the controller 48. In certain embodiments, the drive 44 may include a low rotating inertia engine, such as a low-inertia gas turbine engine. For example, the drive 44 may include an aero-derivative gas turbine engine, such as an LMS100, LM2500, LM6000, LM1800e, LM1600, or TM2500 aero-derivative gas turbine engine manufactured by General Electric Company of Schenectady, N.Y. However, the drive 44 may be any suitable mechanism for rotating the generator 46. Furthermore, the generator 46 may be a low-inertia generator, which has a relatively lightweight rotor. Thus, the drive 44 (e.g., gas turbine) and the generator 46 both may be low inertia rotary devices, which are particularly susceptible to sudden swings or destabilizing events on the grid 12. As discussed in further detail below, without a flywheel 50, the drive 44 and generator 46 may rapidly change in speed in response to a severe change in load on the power grid 12, thereby causing a rapid change in frequency of power output from the generator 46 onto the power grid 12. Accordingly, the disclosed embodiments include the flywheel 50 to increase the inertia and stability of the power units 14 (e.g., 18), while still enabling use of low inertia drives 44 (e.g., gas turbines) and generators 46.

The distributed loads 16 may include a variety of equipment and facilities on the power grid 12. For example, the distributed loads 16 may include residential homes, commercial buildings, industrial facilities, transportation systems, and individual equipment. In general, these distributed loads 16 may gradually change electrical demand over each 24 hour period. For example, peak demand may generally occur at midday, while minimum demand may generally occur at midnight. Over the course of the day, the electrical demand by these distributed loads 16 may generally increase in the morning hours, and subsequently decrease in the afternoon hours. The distributed power units 14 are generally able to respond to these gradual changes in electrical demand on the power grid 12. Unfortunately, rapid load swings on the power grid 12 may create a substantial gap between the electrical power supplied by the distributed power units 14 and the electrical demand by the distributed loads 16. As a result, a large decrease in load may cause the power units 14 to accelerate, thereby increasing the frequency of the power grid 12. Likewise, a large increase in load may cause the power units to decelerate, thereby decreasing the frequency of the power grid 12. The disclosed flywheel 50 helps to add inertia to reduce or minimize sudden acceleration or deceleration of the power units 14 (e.g., 18), thereby helping to stabilize the frequency of power output by the generator 46.

When such frequency-based grid disturbances occur, causing the frequency of the power grid 12 to deviate from a nominal frequency, the controller 48 may instruct the drive 44 to add or remove torque to the generator 46 based on the deviation in frequency of the generator 46. Doing so may add or remove power that, collectively with other distributed power units 14, may return the frequency of the power grid 12 to its nominal frequency. In the meantime, a flywheel 50 coupled to the generator 46, as discussed in detail below, may use stored rotational energy to resist immediate fluctuations in frequency of the generator 46 due to the grid disturbance. The flywheel 50 also provides increased inertia to the generator 46 so that the frequency of power output by the generator 46 does not overshoot a new desired frequency for the power unit 18 when the load on the power grid 12 changes.

Additionally, as illustrated, the utility grid system 40 may be configured to monitor certain system-wide events. For example, the utility grid system 40 may include a protection control 52 and a grid monitor 54, which collectively provide rapid event identification and corrective actions based on various grid destabilizing events throughout the power grid 12. For example, the grid monitor 54 may include a fault monitor 56, a trip monitor 58, and a swing monitor 60. The fault monitor 56 may be configured to rapidly identify a fault, such as a transmission line fault 62, in the power grid 12. The fault 62 may represent a discontinuity in first and second portions 64 and 66 of the power grid 12. As a result, the transmission line fault 62 may disconnect loads 36 and 38 and power units 26 and 28 from the first portion 64 of the power grid 12. The trip monitor 58 may be configured to identify a trip of one or more of the distributed power units 14, such as a trip 68 of the power unit 22. As a result of the trip 68, the electrical power demand by the distributed loads 16 may suddenly exceed the available power by the distributed power units 14. The swing monitor 60 may be configured to identify rapid changes in electrical demand by one or more of the distributed loads 16, such as a swing 70 in the load 32. For example, the swing 70 may represent a sudden increase or decrease in electrical demand in certain equipment, industrial facilities, or the like. In certain embodiments, the controller 48 of each power unit 14 (e.g., 18) and/or the utility grid system 40 may respond to various sensor feedback, and adjust an inertia of the flywheel 50 to help compensate and resist sudden changes to the power output by the generator 46.

Figure 2:
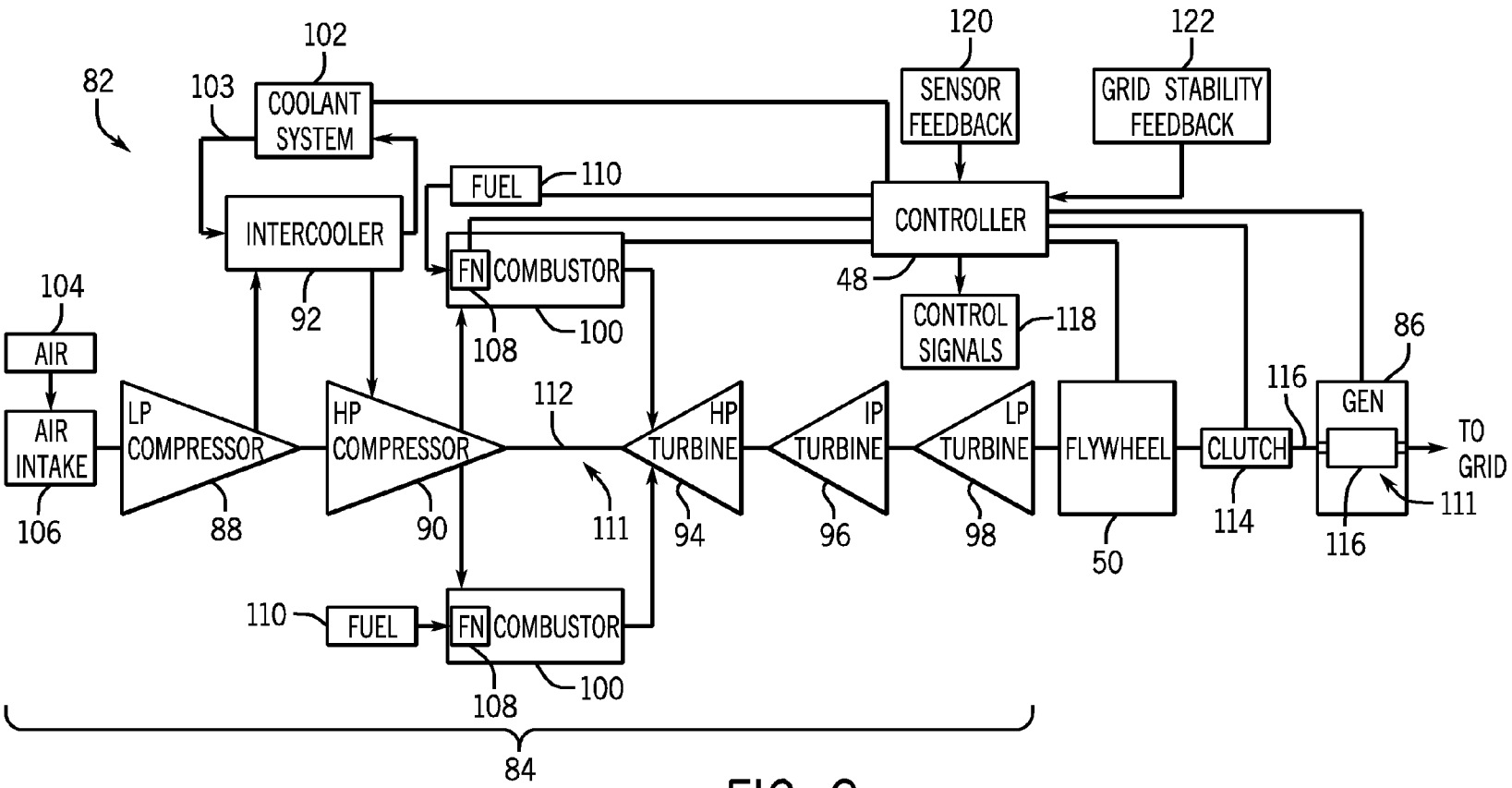
FIG. 2 is a block diagram of an embodiment of a gas turbine engine coupled to an electrical generator with an attached flywheel.

FIG. 2 is a block diagram of an embodiment of a turbine generator 82 including a gas turbine engine 84 coupled to an electrical generator 86. In the illustrated embodiment, the gas turbine engine 84 includes a low pressure compressor 88, a high pressure compressor 90, an intercooler 92 between the low pressure compressor 88 and the high pressure compressor 90, a high pressure turbine 94, an intermediate pressure turbine 96, a low pressure turbine 98, and combustors 100 between the high pressure compressor 90 and the high pressure turbine 94. The intercooler 92 facilitates reducing a temperature of air entering the high pressure compressor 90. This may increase an efficiency of the gas turbine engine 84 while reducing the quantity of work performed by the high pressure compressor 90. In the illustrated embodiment, the intercooler 92 couples to an outlet of the low pressure compressor 88 and an inlet of the high pressure compressor 90 to circulate compressed air through the intercooler 92 (e.g., a heat exchanger) in a closed loop. The intercooler 92 also couples to a coolant system 102 in a closed loop 103, and circulates a coolant (e.g., water, refrigerant, or any suitable gas or liquid) through the intercooler 92 to cool the compressed air. In other embodiments, the intercooler 92 may use ambient air or water as the cooling medium without a closed loop. In still another embodiment, the gas turbine engine 84 may not include the intercooler 92.

In operation, ambient air 104 is drawn into the low pressure compressor 88 through an air intake 106. In the low pressure compressor 88, the air 104 is compressed into a compressed air flow, which is cooled in the intercooler 92, and then the cooled compressed air is channeled downstream to the high pressure compressor 90. The high pressure compressor 90 further compresses the air flow and delivers high-pressure air to the combustors 100, which have fuel nozzles 108 for routing a liquid and/or gas fuel 110, such as natural gas or syngas, into the combustors 100. The compressed air mixes with the fuel 110 in the combustors 100, and the mixture is ignited to generate combustion gas, which is then channeled from the combustors 100 to drive turbines 94, 96, and 98. As will be appreciated, the low pressure turbine 98, intermediate pressure turbine 96, and high pressure turbine 94 are aerodynamically coupled to each other. Collectively, the turbines 94, 96 and 98 turn a rotor 112 (e.g., turbine rotor) to drive the compressors 88 and 90 and the electrical generator 86, which also includes a rotor 116 (e.g., generator rotor). Together, the rotors 112 and 116 may be described as a turbine generator rotor 111. As discussed above, the rotors 112 and 116 (and thus combined rotor 111) may have a relatively low inertia.

The illustrated gas turbine engine 84 may represent the drive 44 of the power unit 18 of FIG. 1, and the electrical generator 86 may represent the corresponding generator 46. In this context, the electrical generator 86 outputs power to the power grid 12, where the power is drawn by one or more distributed loads 16. In order to stabilize the frequency of power output by the electrical generator 86, the flywheel 50 of FIG. 1 is coupled to the gas turbine engine 84 and/or the generator 86. In the illustrated embodiment, the flywheel 50 is positioned axially between the gas turbine engine 84 and the electrical generator 86, coupled to the rotor 111 (e.g., 112 and/or 116) in order to store rotational energy from the gas turbine engine 84 in the flywheel 50. This stored energy helps resist changes in the rotational speed of the electrical generator 86, thereby stabilizing the frequency of power output to the power grid 12 during a grid destabilizing event.

It should be noted that stabilizing the frequency of power output to the power grid 12 helps maintain an overall stability and synchronism between different elements of the power grid 12 (i.e., between the distributed power units 14 and distributed loads 16). As previously mentioned, the controller 48 may control the response of the drive 44 (i.e., the gas turbine generator 84) to various grid instabilities. A resulting change in speed of rotation of the gas turbine engine 84 may cause the electrical generator 86 to output power at a frequency that is no longer synchronous with the frequency of the power grid 12. During conditions of steady state stability, the flywheel 50 coupled with the gas turbine engine 84 functions as a load on the electrical generator 86, absorbing kinetic energy from the gas turbine engine 84. When a grid destabilizing event causes a sudden change in load on the gas turbine engine 84, the kinetic energy stored within the flywheel 50 provides inertia to drive the electrical generator 86 without a sudden change in speed, yielding a smoother frequency response (e.g., less likely to undergo a rapid change). Consequently, the stored kinetic energy may be converted into electrical energy for stabilizing the frequency of power output by the electrical generator 86 to the power grid 12 during transient stability conditions. Again, the embodiments of the flywheel 50 may include inertia adjusters, which may be controlled by the controller 48 to increase or decrease the inertia of the flywheel 50 to improve stability.

In the illustrated embodiment, a clutch 114 is located between the gas turbine engine 84 and the electrical generator 86, connecting the rotor 112 of the gas turbine engine 84 with the rotor 116 of the electrical generator 86. This clutch 114 may disengage the gas turbine engine 84 from the electrical generator 86 from an engaged state to a disengaged state. While in the disengaged state, the electrical generator 86 may operate in a synchronous condensing mode, functioning as an electrical motor.

The controller 48 introduced in FIG. 1 is used to operate, monitor, and control certain components of the turbine generator 82, which may include the coolant system 102, supply of fuel 110, fuel nozzles 108, combustors 100, flywheel 50, clutch 114, and electrical generator 86. More specifically, the controller 48 may monitor and adjust various parameters of these components in order to turn the rotor 112 at a rotational speed to output power to the power grid 12 at a desired frequency. This rotational speed may be determined by the controller 48 based on various control signals 118, sensor feedback 120, and grid stability feedback 122. For example, the controller 48 may receive control signals 118 from the utility grid system 40 related to determining the appropriate frequency of power output for the distributed loads 16 of the power grid 12. In addition, the controller 48 receives grid stability feedback 122 (i.e., data indicative of a grid destabilizing event) from the grid monitor 54 as well as sensor feedback 120 (e.g., signals) from various sensors disposed throughout the turbine generator 82. In response to these different inputs, the controller 48 transmits signals to equipment, devices, control elements, and so forth, to adjust desired process parameters for outputting power to the power grid 12 at a desired frequency.

As previously discussed, the flywheel 50 coupled with the gas turbine engine 84 stores rotational energy from the gas turbine engine 84 in order to resist changes in rotational speed of the electrical generator 86 during a grid destabilizing event. In the illustrated embodiment, the controller 48 is coupled with the flywheel 50, among other components of the turbine generator 82, as the flywheel 50 includes components for adjusting the inertia of the flywheel 50. Certain components of the flywheel 50 may be adjusted in real time by the controller 48 based on the grid stability feedback 122. That is, when a grid destabilizing event is detected or forecast by the grid monitor 54, the controller 48 may send a signal to the flywheel 50 for adjusting the inertia of the flywheel 50. For example, certain sensor feedback may enable prediction of a grid destabilizing event, so that the controller 48 can increase the inertia of the flywheel 50 before any occurrence of a grid destabilizing event. This may further improve stability of the frequency of power provided to the power grid 12 in response to a grid disturbance.

Figure 3:
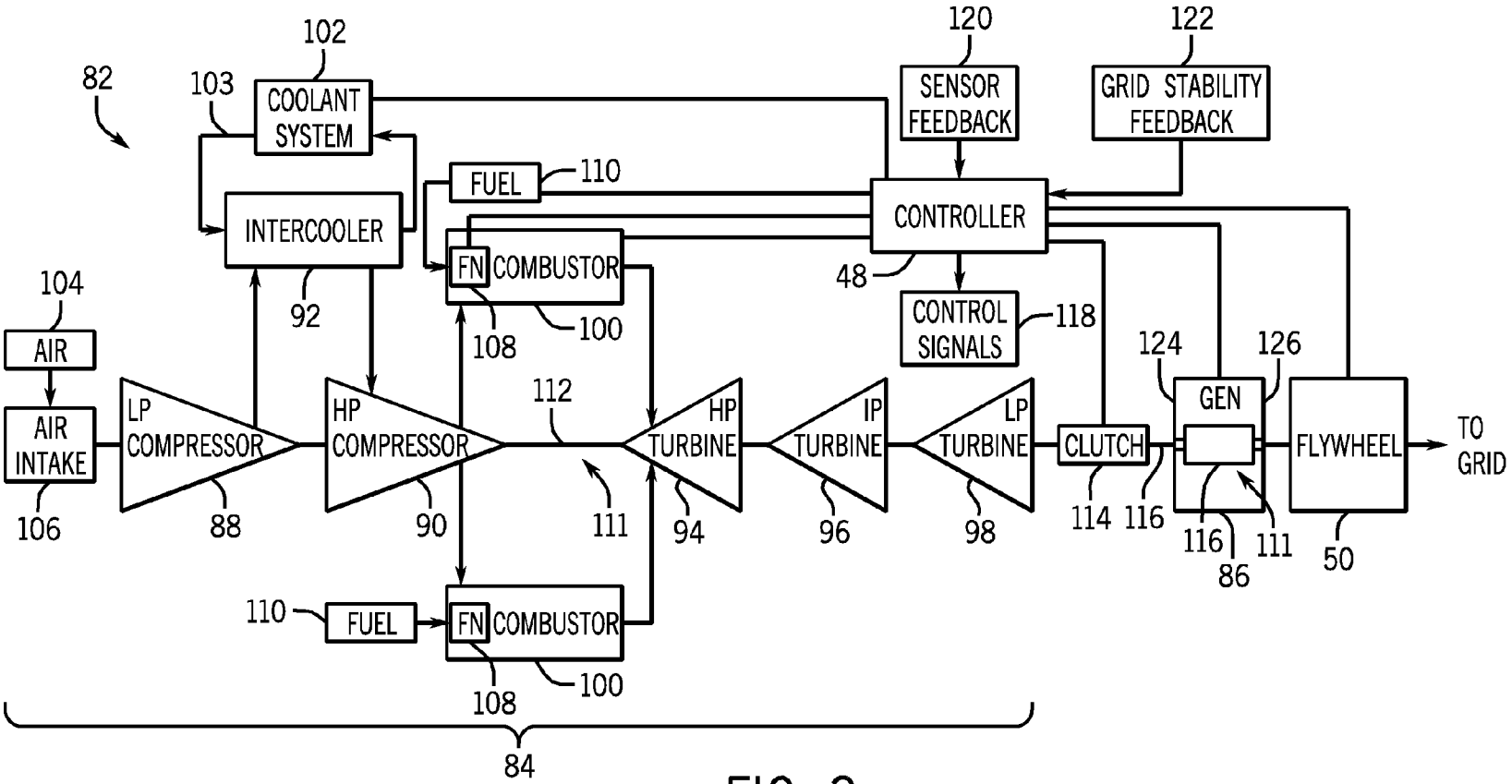
FIG. 3 is a block diagram of an embodiment of a gas turbine engine coupled to an electrical generator with an attached flywheel.

FIG. 3 is a block diagram of an embodiment of a gas turbine engine 84 coupled to an electrical generator 86 with a flywheel 50 attached to the electrical generator 86 in a different configuration than shown in FIG. 2. More specifically, the electrical generator 86 features a first axial side 124 facing the gas turbine engine 84 and a second axial side 126 facing away from the gas turbine engine 84, and the flywheel 50 is positioned on the second axial side 126 of the electrical generator 86. This allows the flywheel 50 to continue rotating (with rotational energy stored from the gas turbine engine 84) when the clutch 114, which is located on the first axial side 124, disengages the gas turbine engine 84 from the electrical generator 86. Indeed, in this position, the rotational energy stored in the flywheel 50 may resist changes in rotational speed of the electrical generator 86 even as the electrical generator 86 operates in a synchronous condensing mode. In this mode, as will be appreciated, the electrical generator 86 is disengaged from the gas turbine engine 84 in order to function as a synchronous electric motor. This allows the electrical generator 86 to adjust certain conditions (i.e., voltage and current) of the power grid 12 using the rotational kinetic energy stored in the both the electrical generator 86 and flywheel 50.

Figure 4:
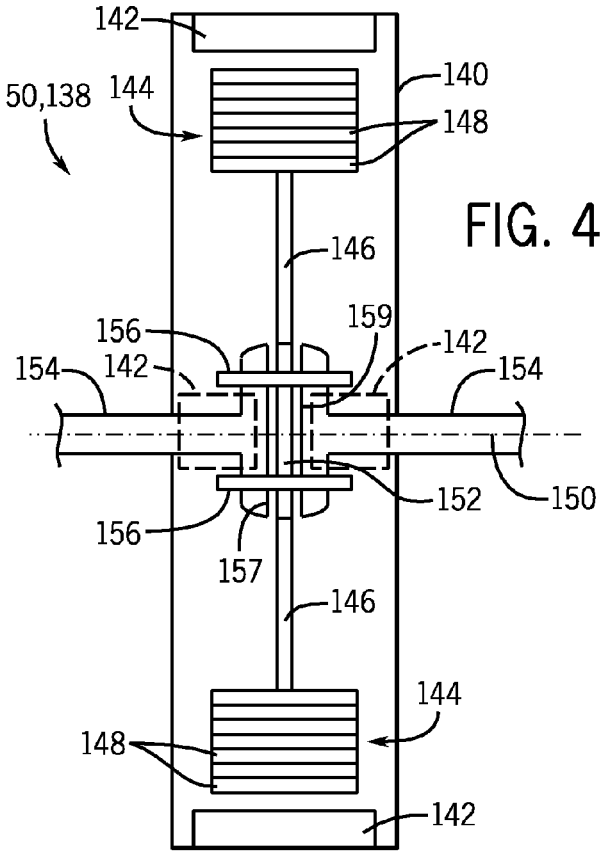
FIG. 4 is a cross-sectional side view of an embodiment of the flywheel of FIGS. 2 and 3.

FIG. 4 is a cross-sectional side view of an embodiment of the flywheel 50 of FIGS. 2 and 3. The flywheel 50 may be a turbine generator flywheel 138 configured to couple to the turbine generator 82 having the gas turbine engine 84 coupled to the electrical generator 86. The illustrated flywheel 50, 138 includes a vacuum enclosure 140, one or more magnetic bearings 142, and weight sets 144. Each weight set 144 includes a radial support 146 and a plurality of weights 148. The radial supports 146 extend from a rotational axis 150, and the weights 148 of each weight set 144 are radially stacked at a peripheral portion of the corresponding radial support 146. In the illustrated embodiment, the radial supports 146 are coupled to and extending from a hub 152 of the flywheel 50, 138, and the hub 152 is held between two sections of a rotor 154 by bolts 156.

The rotor 154 may be the gas turbine engine rotor 112 as shown in the flywheel arrangement of FIG. 2, or the electrical generator rotor 116 as shown in the flywheel arrangement of FIG. 3, or generally part of the rotor 111. That is, the flywheel 50, 138 may be designed to rotate about the rotational axis 150 at the rotational speed of the gas turbine engine 84 and/or at the speed of the electrical generator 86. When the flywheel 50, 138 is coupled with the electrical generator 86, the electrical generator rotor 116 forms at least part of the rotor 154 and the flywheel 50, 138 effectively becomes part of the electrical generator rotor 116. It should be noted that unless the clutch 114 has disengaged the gas turbine engine 84 from the electrical generator 86, the flywheel 50, 138, gas turbine engine 84, and electrical generator 86 will rotate at approximately the same rotational speed, regardless of the relative axial position of the flywheel 50, 138. In embodiments that do not include the clutch 114, a rotor 154 disposed on a first axial side 157 of the hub 152 may be the gas turbine engine rotor 112, while a rotor 154 on a second axial side 159 may be the electrical generator rotor 116. In this arrangement, the rotors 112 and 116 (e.g., collectively rotor 111) may not be disengaged to allow the electrical generator 86 to operate in different modes (e.g., synchronous condensing mode), but instead are configured to rotate at the same speed. Although illustrated as a bolted connection between two portions of the rotor 154, other rotor arrangements and connection mechanisms may be employed for coupling the flywheel 50, 138 to the turbine generator 82. For example, the rotor 154 may be one piece that couples to and extends through the hub 152 of the flywheel 50, 138. In addition, other types of connections may be used to rotationally couple the flywheel 50, 138 with the rotor 154.

It should be noted that the flywheel 50, 138 may be manufactured separately from the electrical generator 86. This allows the individual flywheel 50, 138 to be designed specifically for a given electrical generator 86 in accordance with the loads expected for the particular turbine generator application. In addition, the flywheel 50, 138 may be designed to couple with the gas turbine engine 84 and/or the electrical generator 86 in a desired arrangement (i.e., location along the rotational axis 150). In other embodiments, the flywheel 50, 138 may be designed and manufactured as an integral component of the turbine generator 82. However, it may be beneficial to configure the flywheel 50, 138 as a separate, removable component relative to the gas turbine 84 (e.g., rotor 112) and the generator 86 (e.g., rotor 116). As a result, the gas turbine engine 84 and the generator 86 both may be constructed as low inertia rotary devices, which may be significantly more compact, lightweight, and easier to transport, service, and repair. The flywheel 50, 138 then adds any needed inertia to stabilize the turbine generator 82.

The flywheel 50, 138 may be sealed within the vacuum enclosure 140, or some other low pressure enclosure, and magnetic bearings 142 may be positioned along the rotor 111 and/or along an outer radial edge of the vacuum enclosure 140. The vacuum enclosure 140 with the magnetic bearings 142 may help reduce friction of the rotating flywheel 50, 138 by levitating and supporting the rotating flywheel 50, 138 away from non-moving parts of the turbine generator 82. Additional bearings may be located within the gas turbine engine 84 and the electrical generator 86 as well for reducing friction in these other rotational components. In this way, the flywheel 50, 138 may help maintain the rotational speed of the electrical generator 86 to which it is coupled, stabilizing the power output by the electrical generator 86.

The flywheel 50, 138 may be particularly useful in applications using light-weight turbine generators 82 (e.g., light weight/low inertia turbines 84 and/or generators 86). Unlike a heavy-weight rotor, the flywheel 50, 138 may add inertia to the turbine generator 82 without adding substantial weight to the system. Rotational kinetic energy is stored in the flywheel 50, 138 while the electrical generator 86 operates at steady state conditions, and during transient conditions (e.g., grid instabilities caused by grid destabilizing events) the stored rotational energy resists changes in the rotational speed of the electrical generator 86. The kinetic energy stored in the flywheel 50, 138 may be converted to electrical energy for stabilizing the frequency of power output by the electrical generator 86.

The illustrated arrangement of weight sets 144 may provide an increased inertia for storing rotational kinetic energy while maintaining a sufficiently low weight of the turbine generator 82. Since the weights 148 are located at a peripheral portion of each radial support 146, relatively less weight may be added to the system to increase the rotational inertia of the electrical generator 86 to a desired level, when compared to adding weight directly to the rotor 154. The weights 148 may be rectangular plates made from high tension steel or carbon fiber composite that are bolted and/or welded together in groups of approximately 1 to 100 weights 148 (e.g., 2 to 50, 3 to 25, 4 to 20, or 5 to 10 weights). Using multiple plates for the weights 148 may allow easier manufacturing of each weight set 144. Also, additional weights 148 may later be added to the weight sets 144 in order to further increase the inertia of the flywheel 50, 138 or to balance the weight sets 144 (e.g., if one weight set 144 weighs slightly less than the others). The weights 148 are coupled (i.e., bolted and/or welded) to the radial supports 146, which may also be constructed from high tension steel or carbon fiber composite. Either material may provide an appropriate amount of stiffness to the rotating flywheel 50, 138, while maintaining a relatively low weight of the system. However, the carbon fiber composite has a relatively higher tensile strength and relatively lower weight compared to steel. The hub 152 may be constructed from any suitable metal, since less stiffness may be desired due to the lower torque applied to the rotating hub 152.

Figure 5:
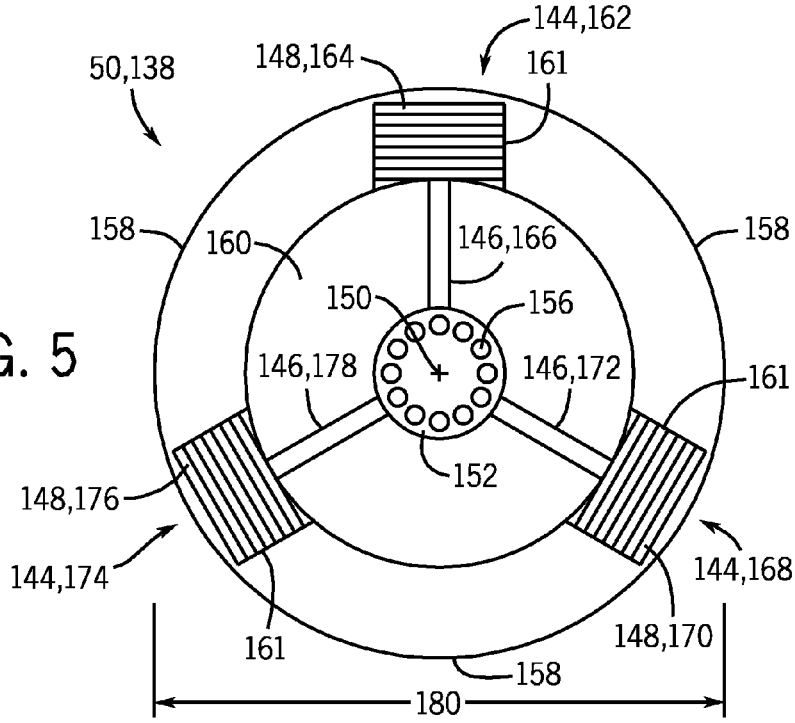
FIG. 5 is a front view of an embodiment of the flywheel of FIG. 4 having three weight sets.

FIG. 5 is a front view of an embodiment of the flywheel 50, 138 of FIG. 4 having three weight sets 144 symmetrically arranged about the axis 150. The illustrated embodiment does not show the vacuum enclosure 140 with magnetic bearing 142, but instead shows the weight sets 144 coupled to the hub 152, with support structures 158 between the weights 148 of each weight set 144. These support structures 158 may be welded or bolted between the weight sets 144 in order to maintain proper alignment of the weights 148 relative to each other as they are rotated about the rotational axis 150. In certain embodiments, a single annular support structure 158 may be provided with radial clots or cavities 161 to support the weight sets 144. The illustrated embodiment also features space 160 (e.g., a generally annular space) between the support structures 158 and the hub 152 in order to maintain a relatively low weight of the flywheel 50, 138.

It should be noted that using an even number of weight sets 144 (e.g., two or four weight sets 144) for the flywheel 50, 138 may result in undesirable effects due to harmonics of the rotating flywheel 50, 138. Therefore, an odd number (e.g., 3, 5, 7, or 9) of weight sets 144 may be included in the flywheel 50, 138, with the radial supports 146 of each weight set 144 mounted to the hub 152 at equally spaced angles (e.g., 120, 72, 51.4, or 40 degrees). Such equal circumferential spacing of the weight sets 144 about the rotational axis 150 may balance the weight of the flywheel 50, 138, which is important since the flywheel 50, 138 may be rotated at speeds of approximately 3600 RPM. The weight sets 144 of the flywheel 50, 138 may also be referred to as weight assemblies, including at least one weight 148 coupled to a radial arm (i.e., radial support 146). Therefore, the illustrated embodiment features a flywheel 50, 138 having at least a first weight assembly 162 including a first weight 164 coupled to a first radial arm 166, a second weight assembly 168 including a second weight 170 coupled to a second radial arm 172, and a third weight assembly 174 including a third weight 176 coupled to a third radial arm 178. However, as previously mentioned, the flywheel 50, 138 may feature more weight assemblies arranged circumferentially about the rotational axis 150 of the flywheel 50, 138.

Due to the approximate size, weight, and other properties of the turbine generators 82 to which the disclosed flywheels 50 will be applied, certain ranges of size, weight, and inertia of the flywheel 50 may be desired. For example, the flywheel 50 may feature a diameter 180 that falls within a certain desired range, e.g., 2 to 8, 2.5 to 6, or 3 to 5 meters, or greater than or equal to approximately 2, 3, 4, 5, or 6 meters. Further, the flywheel 50 may feature a certain desired relative mass compared to a rotor 112 mass of the gas turbine engine 84 and/or the rotor 116 mass of the generator 116, e.g., greater than approximately 25, 30, 35, 40, 45, or 50 percent of the mass of a rotor of the turbine generator 82, e.g., the rotor 112, the rotor 116, or the combined rotor 111 (e.g., 112 and 116). The mass of the flywheel 50 may otherwise fall within a certain range, e.g., 20 to 65, 25 to 60, 30 to 55, or 40 to 50 percent of the mass of the rotor 112, the rotor 116, or the combined rotor 111 (e.g., 112 and 116). Still further, it may be desirable for the flywheel 50 to feature a certain inertia (i.e., moment of inertia) based on the size, shape, and weight distribution of the flywheel 50. For example, the flywheel 50 may have an inertia greater than approximately 750, 1000, 1250, or 1500 $kg \cdot m^2$, within a desired range, e.g., 750 to 2500, 1000 to 2000, 1250 to 1750 $kg \cdot m^2$, or approximately 1500 $kg \cdot m^2$. Other ranges and approximate limits of these and other properties of the flywheel may be apparent to those skilled in the art and useful for determining the appropriate flywheel 50 for use with a particular turbine generator 82.

Figure 6:
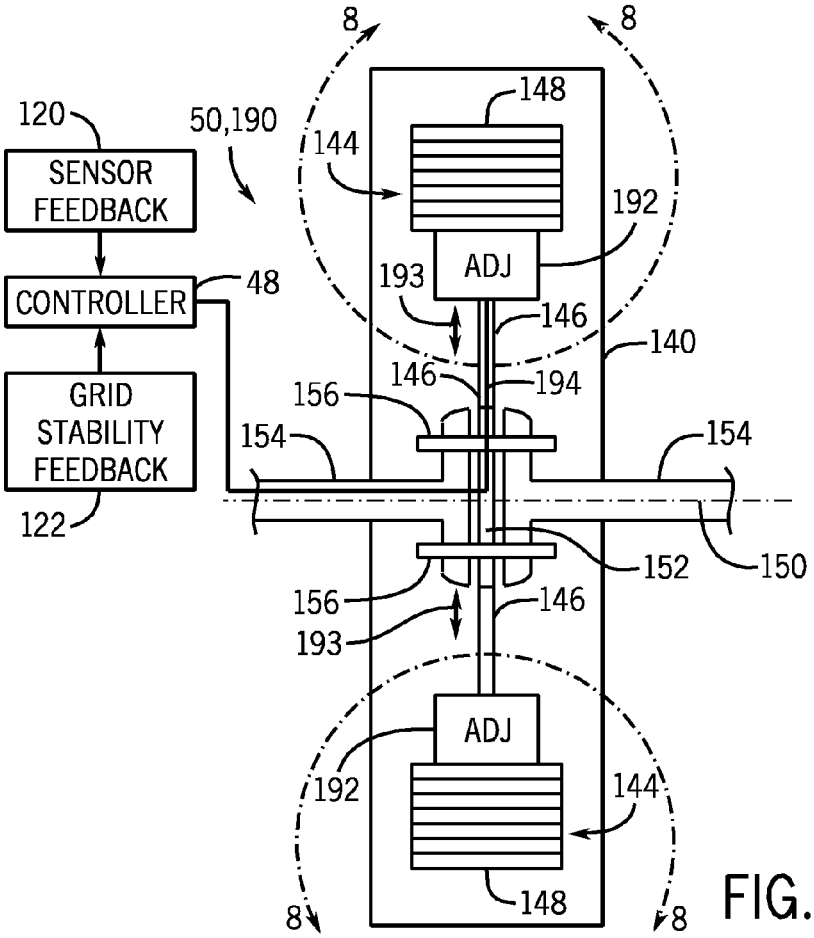
FIG. 6 is a cross-sectional side view of an embodiment of the flywheel of FIGS. 2 and 3, including inertia adjusters.

FIG. 6 is a cross-sectional side view of an embodiment of the flywheel 50 of FIGS. 2 and 3, which includes an adjustable inertia flywheel 190 in accordance with present techniques. The adjustable inertia flywheel 190 allows the weight distribution and, therefore, the inertia of the flywheel 50, 190 to be adjusted using one or more radial adjusters 192 coupled to the weights 148 along the periphery of the flywheel 50, 190. The radial adjusters 192 are configured to move at least one weight 148 in a radial direction, indicated by arrow 193, along the radial support 146 in order to change the inertia of the flywheel 50, 190. In the illustrated embodiment, the controller 48 is coupled to the flywheel 50, 190 in order to adjust the inertia of the flywheel 50, 190 based on feedback (e.g., sensor feedback 120, grid stability feedback 122, etc.). More specifically, the controller 48 operates the radial adjusters 192 through control signals sent via a control line 194 from the controller 48 to the radial adjusters 192. This control line 194 may be routed through the rotor 154 in order to rotate as the rotor 154 and flywheel 50, 190 rotate. In response to certain feedback (i.e., data indicative or predictive of a grid destabilizing event), the controller 48 may signal the radial adjusters 192 of the flywheel 50, 190 to move the weights 148 in an outward radial direction (arrow 193). Consequently, the inertia of the flywheel 50, 190 may be increased, allowing the flywheel 50, 190 to store a greater amount of rotational energy from the gas turbine engine 84 for resisting changes in the rotational speed of the electrical generator 86.

Figure 7:
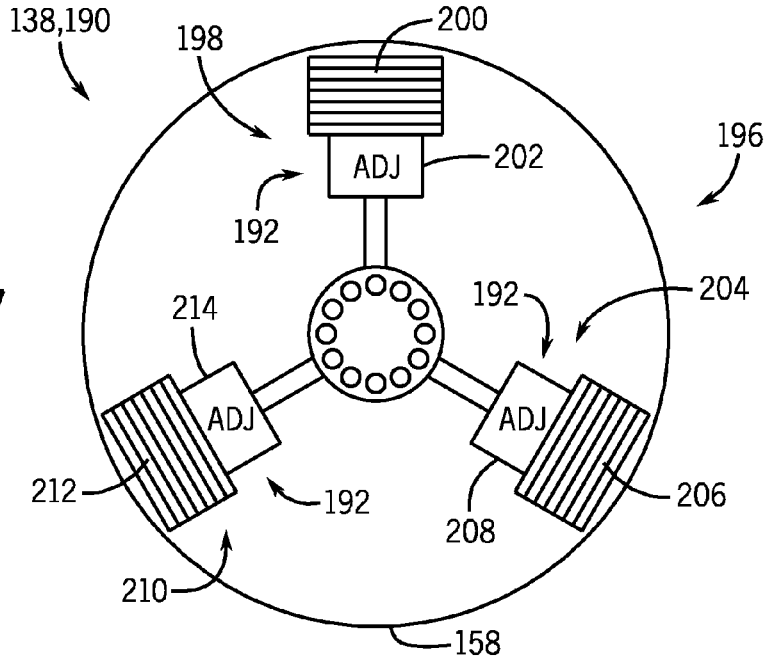
FIG. 7 is a front view of an embodiment of the adjustable inertia flywheel of FIG. 6 having three sets of weights and radial adjusters.

FIG. 7 is a front view of an embodiment of the flywheel 50, 190 of FIG. 6 having three sets of weights 148 and radial adjusters 192. This may also be described as the turbine generator flywheel 138 of FIGS. 4 and 5 having an adjustable inertia mechanism 196 (e.g., three radial adjusters 192). Similar to the arrangement shown in FIG. 5, the adjustable inertia flywheel 190 (or turbine generator flywheel 138 with adjustable inertia mechanism 196) may feature a first inertia adjuster 198 having a first weight 200 (or plurality of weights, e.g., 1 to 10 or more) coupled to a first radial adjuster 202, a second inertia adjuster 204 having a second weight 206 (or plurality of weights, e.g., 1 to 10 or more) coupled to a second radial adjuster 208, and a third inertia adjuster 210 having a third weight 212 (or plurality of weights, e.g., 1 to 10 or more) coupled to a third radial adjuster 214. In operation, the radial adjusters 202, 208, and 214 adjust (e.g., increase or decrease) a radial position of the corresponding weights 200, 206, and 212, with respect to the rotational axis 150 of the flywheel 138, 190. In the illustrated embodiment, the first, second, and third inertia adjusters 198, 204, and 210 are circumferentially spaced about the rotational axis 150 of the flywheel 138, 190 at angles of approximately 120 degrees from each other. In other embodiments, other numbers of inertia adjusters may be used to circumferentially distribute the weight of the flywheel 138, 190. The radial adjusters 192 (e.g., 202, 208, and 214) may be electrically driven, hydraulically driven, pneumatically driven, gear driven, or driven by any suitable driving arrangement.

Figure 8:
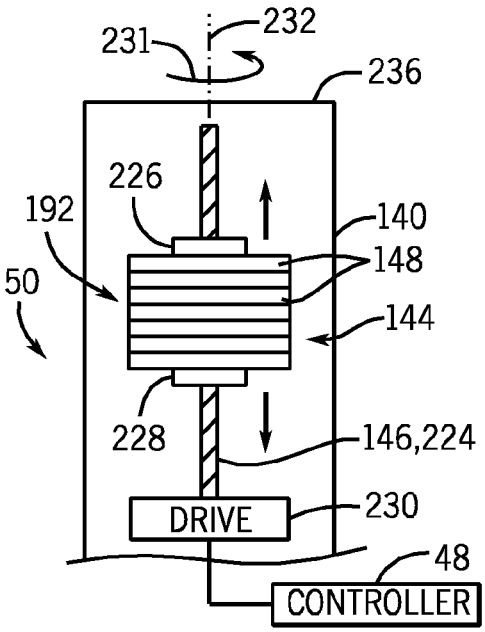
FIG. 8 is a side view of an embodiment of the flywheel of FIG. 6, taken within line 8-8, illustrating the controller moving weights via the radial adjuster to an intermediate inertia position along the radial support.
Figure 9:
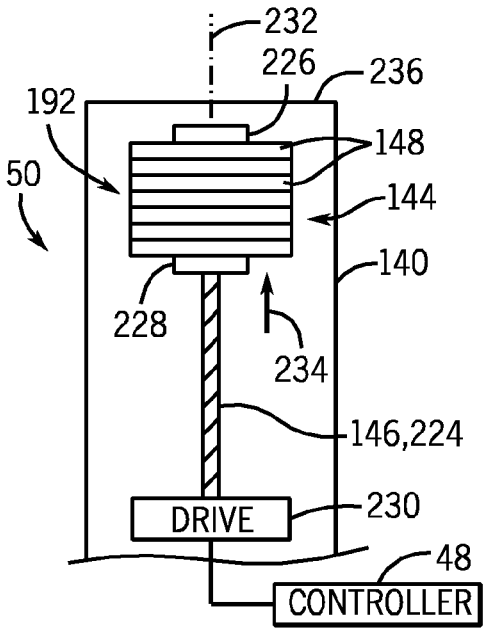
FIG. 9 is a side view of an embodiment of the flywheel of FIG. 6, taken within line 8-8, illustrating the controller moving the weights via the radial adjuster to a high inertia position along the radial support.
Figure 10:
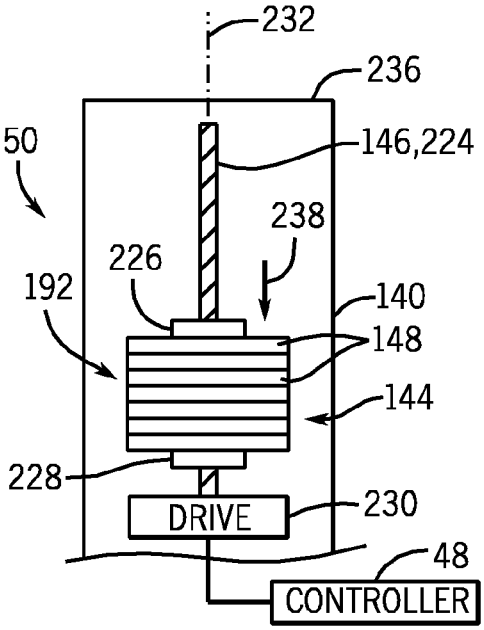
FIG. 10 is a side view of an embodiment of the flywheel of FIG. 6, taken within line 8-8, illustrating the controller moving the weights via the radial adjuster to a low inertia position along the radial support.

FIGS. 8-10 show side views of an embodiment of the flywheel 50 of FIG. 6, taken within line 8-8, illustrating the controller 48 moving weights 148 via the radial adjuster 192 to an intermediate inertia position, a high inertia position, and a low inertia position, respectively, along the radial support 146. The illustrated radial adjuster 192 includes an ACME lead screw 224 and ACME nuts 226 and 228 that are each coupled with the stacked weights 148. The displacement of the nuts 226 and 228 along the radial support 146 may be adjusted by turning the threaded lead screw 224. The radial adjuster 192 includes a drive 230, which may be an electric, hydraulic, or other appropriate drive, configured to turn the lead screw 224, for adjusting the position of the ACME nuts 226 and 228, and the weights 148, along the radial support 146. Multiple drives 230 may be included in the flywheel 50, one located along each radial support 146, and the controller 48 may operate the drives 230 to coordinate adjustments of the weights 148 along each radial support 146. The controller 48 also may independently control the radial adjusters 192 to help balance the flywheel 50. As the lead screw 224 is turned 231 about a screw axis 232, the nuts 226 and 228, which may be threaded onto the lead screw 224 in a fixed offset distance with respect to the axis 232, may be forced to travel up or down the lead screw 224 in order to move the connected weights 148 while holding the weights 148 together. In this way, the radial adjuster 192 may be used to adjust the radial position of the weights 148 along the radial support 146. Although the illustrated embodiment uses an ACME screw assembly, other embodiments may employ different mechanisms for adjusting the radial position of the weights 148 along the radial support 146.

FIG. 8 illustrates the weights 148 positioned at an intermediate inertia position along the radial support 146. With the weights 148 in this position, the flywheel 50 has a relatively intermediate inertia, which may be increased or decreased by moving the weights 148 outward or inward, respectively. FIG. 9 illustrates the movement of the weights 148 from this intermediate position along the radial support 146 in response to feedback related to a grid destabilizing event (e.g., predictive of the event and/or before the turbine generator 82 is substantially impacted by the event). The controller 48 signals the drive 230 to turn the lead screw 224 in a direction that moves the weights 148 in an outward radial direction, indicated by arrow 234, toward an outer edge 236 of the flywheel 50. As the weights 148 are repositioned toward the outer edge 236, the moment of inertia of the flywheel 50 increases significantly, since more weight is concentrated further from the rotational axis 150. This increased inertia allows the flywheel 50 to store additional rotational energy for resisting changes in rotational speed of the electrical generator 86 during the grid destabilizing event. Likewise, FIG. 10 illustrates the movement of the weights 148 along the radial support 146 in an inward radial direction away from the outer edge 236 of the flywheel 50 toward the axis 150, as indicated by arrow 238. This may occur when the grid stability feedback 122 no longer indicates a grid destabilizing event, and a relatively higher inertia is no longer desired for the flywheel 50. For example, it may be desirable to reduce the inertia (FIG. 10) to help slow down the rotor 112, 116, or 111 at a faster rate for servicing or other reasons.

Figure 11:
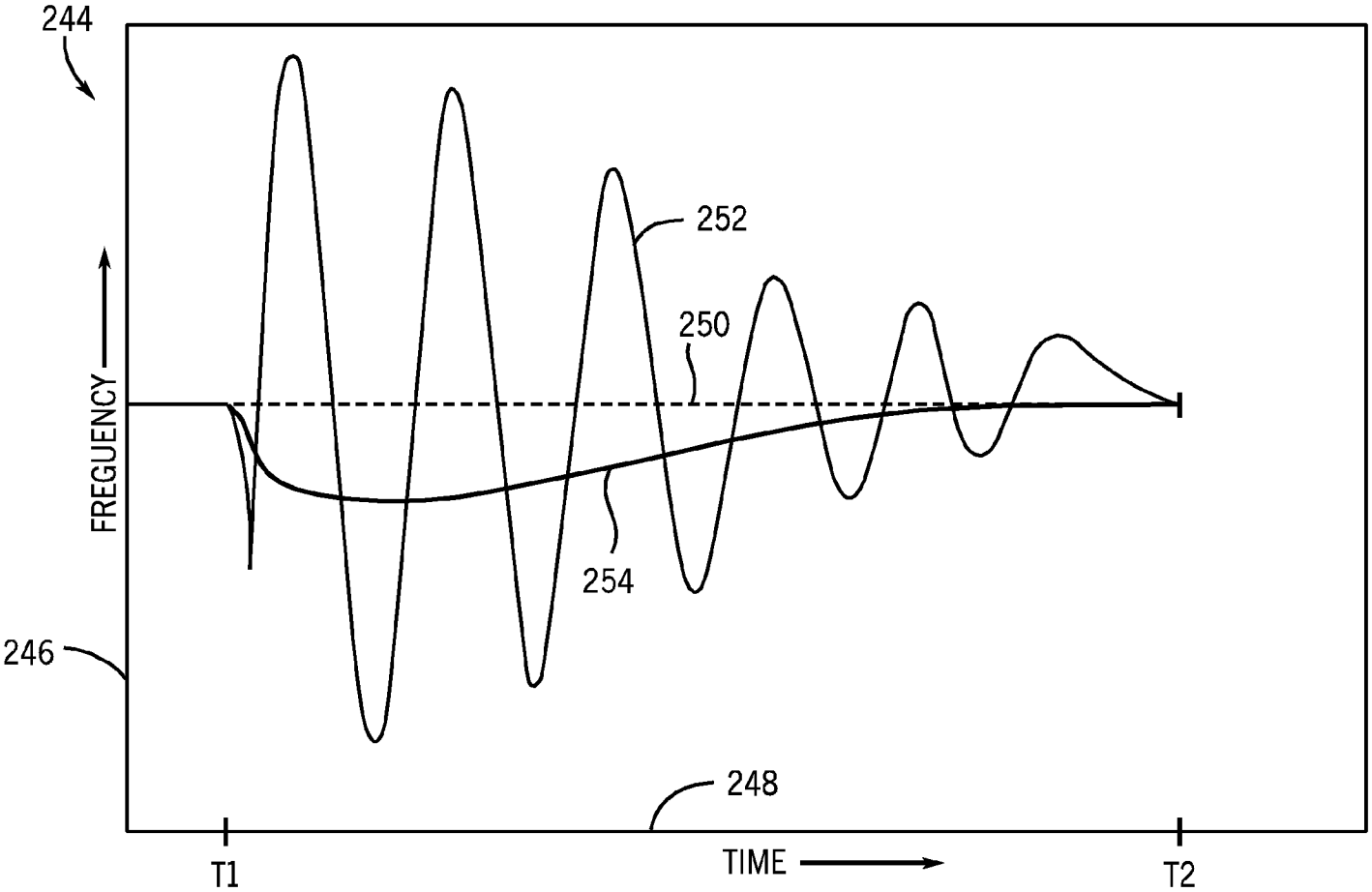
FIG. 11 is a plot modeling embodiments of two frequencies output by an electrical generator in response to a grid destabilizing event, the frequencies corresponding to the electrical generator operating with and without an attached flywheel.

FIG. 11 is a plot 244 modeling embodiments of two frequencies of power output by an electrical generator in response to a grid destabilizing event, one frequency corresponding to the electrical generator with a flywheel attached in accordance with present techniques and the other corresponding to the electrical generator without an attached flywheel. The plot 244 illustrates frequency of power (ordinate 246) against time (abscissa 248) beginning when a frequency disturbance, corresponding to a grid destabilizing event, occurs at time T1. In this particular instance, the grid destabilizing event may be a trip in a power unit of the power grid 12 or a swing of a distributed load of the power grid 12, causing the frequency of power output by the electrical generator 86, both with and without the flywheel 50, to decrease below a desired frequency 250 at time T1. A trace 252 indicates the frequency response of power output by the electrical generator 86 without the attached flywheel 50, e.g., as the controller 48 tries to stabilize the frequency. The resulting frequency fluctuates about the desired frequency 250 before eventually stabilizing at time T2. In contrast, trace 254 on the plot 244 illustrates the response of frequency output to the power grid 12 by the electrical generator 86 with the attached flywheel 50. The response is noticeably smoother than that shown by trace 252, and the frequency does not fluctuate (or may only minimally fluctuate) about the desired frequency 250. Instead, the trace 254 drops below the desired frequency 250 before gradually approaching the desired frequency 250, and the trace 254 stabilizes the frequency of power output to the power grid 12 before time T2. In addition, the magnitude of the frequency response (e.g., drop and/or rise) shown in trace 254 is substantially less than the magnitude of the response shown in trace 252. That is, the flywheel 50 substantially decreases the amount of initial drop in frequency of power output relative to the desired frequency 250. If the magnitude of a change in frequency relative to the desired frequency 250 is too large, e.g., due to a grid destabilizing event, a brownout or blackout may occur on the power grid 12. The flywheel 50, by increasing the inertia of the electrical generator 86, reduces the effect of the grid disturbance on the rotational speed of the electrical generator 86, allowing a relatively lower magnitude and more gradual response to grid destabilizing events and, consequently, a more stable output of frequency of power from the electrical generator 86 to the power grid 12.

Technical effects of the invention include, among other things, stabilizing power output by relatively lightweight turbine generator systems in response to grid destabilizing events on the power grid. The attached flywheel 50 stores rotational energy from a gas turbine engine to resist changes in rotational speed of an electrical generator caused by such grid destabilizing events. For example, the electrical generator may allow rotational kinetic energy stored in the flywheel 50 to be converted to electrical energy for increasing the power output to the power grid when a load on the grid suddenly increases. Certain features of the flywheel 50 may allow an adjustment of the rotational inertia of the flywheel, and certain embodiments include a controller for closed loop adjustment of the inertia of the flywheel 50 based on feedback related to power grid stability. These and other features may equip a lightweight electrical generator to provide smooth frequency responses to grid destabilizing events through the use of stored mechanical energy.

This written description uses examples to disclose the invention, including the best mode, and also to enable any person skilled in the art to practice the invention, including making and using any devices or systems and performing any incorporated methods. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims.

The invention claimed is:

1. A system, comprising:

a gas turbine engine, wherein the gas turbine engine comprises a low pressure compressor, a high pressure compressor, an intercooler between the low pressure compressor and the high pressure compressor, a high pressure turbine, an intermediate pressure turbine, a low pressure turbine, and at least one combustor between the high pressure compressor and the high pressure turbine;

an electrical generator coupled to the gas turbine engine, wherein the electrical generator is configured to output a power to a power grid; and a flywheel coupled to the gas turbine engine, wherein the flywheel is configured to store a rotational energy from the gas turbine engine, and the rotational energy stored by the flywheel is configured to resist changes in a rotational speed of the electrical generator to stabilize a frequency of the power during a grid destabilizing event on the power grid.

2. The system of claim 1, wherein the flywheel is disposed axially between the gas turbine engine and the electrical generator.

3. The system of claim 1, wherein the electrical generator has a first axial side facing the gas turbine engine and a second axial side facing away from the gas turbine engine, and the flywheel is disposed on the second axial side.

4. The system of claim 3, comprising a clutch disposed axially between the gas turbine engine and the electrical generator on the first axial side, wherein the clutch is configured to disengage the gas turbine engine from the generator from an engaged state to a disengaged state, and the generator is configured to function as an electrical motor in the disengaged state.

5. The system of claim 1, wherein the flywheel comprises a vaccum enclosure, a magnetic bearing, and a plurality of weight sets spaced circumferentially about a rotational axis, wherein each weight set of the plurality of weight sets comprises a radial support extending away from the rotational axis, and a plurality of weights radially stacked at a peripheral portion of the radial support.

6. The system of claim 1, wherein the flywheel has a diameter of at least 4 meters, or the flywheel has a flywheel mass that is at least approximately 40 percent of a mass of a rotor of the system, or a combination thereof.

7. The system of claim 1, wherein the flywheel has an inertia of at least 1000 $kg \cdot m^2$.

8. The system of claim 1, wherein the flywheel comprises an adjustable inertia flywheel.

9. The system of claim 8, wherein the adjustable inertia flywheel comprises at least one weight coupled to a radial adjuster configured to move the at least one weight in a radial direction relative to a rotational axis.

10. The system of claim 9, wherein the adjustable inertia flywheel comprises a first inertia adjuster having a first weight coupled to a first radial adjuster, a second inertia adjuster having a second weight coupled to a second radial adjuster, and a third inertia adjuster having a third weight coupled to a third radial adjuster, wherein the first, second, and third inertia adjusters are circumferentially spaced about the rotational axis.

11. The system of claim 8, comprising a controller coupled to the adjustable inertia flywheel, wherein the controller is configured to adjust an inertia of the flywheel in response to feedback.

12. The system of claim 11, wherein the feedback comprises data indicative of the grid destabilizing event.

13. A system, comprising:

a turbine generator flywheel configured to couple to a turbine generator having a gas turbine engine coupled to an electrical generator, wherein the turbine generator flywheel is configured to store a rotational energy from the gas turbine engine, the rotational energy stored by the turbine generator flywheel is configured to resist changes in a rotational speed of the electrical generator to stabilize a frequency of the power during a grid destabilizing event on the power grid, and the turbine generator flywheel comprises an adjustable inertia mechanism having at least one weight coupled to a radial adjuster configured to move the at least one weight in a radial direction relative to a rotational axis, and a controller coupled to the radial adjuster to move the at least one weight to adjust an inertia of the turbine generator flywheel to help stabilize the frequency of the power.

14. The system of claim 13, wherein the radial adjuster comprises an electric drive.

15. The system of claim 13, wherein the adjustable inertia mechanism comprises a first inertia adjuster having a first weight coupled to a first radial adjuster, a second inertia adjuster having a second weight coupled to a second radial adjuster, and a third inertia adjuster having a third weight coupled to a third radial adjuster, wherein the first, second, and third inertia adjusters are circumferentially spaced about the rotational axis.

16. The system of claim 13, comprising the turbine generator having the turbine generator flywheel.

17. A system, comprising:

a gas turbine engine comprising at least one compressor stage, at least one combustor, and at least one turbine stage; and a flywheel coupled to the gas turbine engine, wherein the flywheel is configured to store a rotational energy from the gas turbine engine, wherein the rotational energy stored by the flywheel is configured to resist changes in a rotational speed, wherein the flywheel has an inertia of at least 1000 $kg \cdot m^2$, wherein the flywheel comprises a first weight assembly having a first weight coupled to a first radial arm, a second weight assembly having a second weight coupled to a second radial arm, and a third weight assembly having a third weight coupled to a third radial arm, wherein the first, second, and third weight assemblies are circumferentially spaced about a rotational axis.

18. The system of claim 17, comprising an electrical generator coupled to the gas turbine engine, wherein the electrical generator is configured to output a power to a power grid and the rotational energy stored by the flywheel is configured to resist changes in the rotational speed of the electrical generator to stabilize a frequency of the power during a grid destabilizing event on the power grid.

19. A system, comprising:

a gas turbine engine;

an electrical generator coupled to the gas turbine engine, wherein the electrical generator is configured to output a power to a power grid; and a flywheel coupled to the gas turbine engine, wherein the flywheel is configured to store a rotational energy from the gas turbine engine, and the rotational energy stored by the flywheel is configured to resist changes in a rotational speed of the electrical generator to stabilize a frequency of the power during a grid destabilizing event on the power grid, wherein the flywheel comprises a vaccum enclosure, a magnetic bearing, and a plurality of weight sets spaced circumferentially about a rotational axis, wherein each weight set of the plurality of weight sets comprises a radial support extending away from the rotational axis, and a plurality of weights radially stacked at a peripheral portion of the radial support.

20. A system, comprising:

a gas turbine engine;

an electrical generator coupled to the gas turbine engine, wherein the electrical generator is configured to output a power to a power grid; and an adjustable inertia flywheel coupled to the gas turbine engine, wherein the adjustable inertia flywheel is configured to store a rotational energy from the gas turbine engine, and the rotational energy stored by the adjustable inertia flywheel is configured to resist changes in a rotational speed of the electrical generator to stabilize a frequency of the power during a grid destabilizing event on the power grid, wherein the adjustable inertia flywheel comprises a first inertia adjuster having a first weight coupled to a first radial adjuster configured to move the first weight in a first radial direction relative to a rotational axis, a second inertia adjuster having a second weight coupled to a second radial adjuster configured to move the second weight in a second radial direction relative to the rotational axis, and a third inertia adjuster having a third weight coupled to a third radial adjuster configured to move the third weight in a third radial direction relative to the rotational axis, wherein the first, second, and third inertia adjusters are circumferentially spaced about the rotational axis.

* * * * *